US007806748B2

(12) United States Patent
Richardson

(10) Patent No.: US 7,806,748 B2
(45) Date of Patent: Oct. 5, 2010

(54) BRA AND SYSTEM HAVING A BAY AND A TRUSS AND METHOD FOR USING THE SAME

(76) Inventor: Tanya Richardson, 6126 S. University, Chicago, IL (US) 60637

( * ) Notice: Subject to any disclaimer, the term of this patent is extended or adjusted under 35 U.S.C. 154(b) by 994 days.

(21) Appl. No.: 11/599,944

(22) Filed: Nov. 15, 2006

(65) Prior Publication Data

US 2008/0113587 A1 May 15, 2008

(51) Int. Cl.
*A41C 3/00* (2006.01)

(52) U.S. Cl. ..... 450/61; 450/66; 450/86

(58) Field of Classification Search ..... 450/60–66, 450/85–87, 1
See application file for complete search history.

(56) References Cited

U.S. PATENT DOCUMENTS

| | | | | | |
|---|---|---|---|---|---|
| 525,241 | A | * | 8/1894 | Tucek | 450/58 |
| 1,815,664 | A | * | 7/1931 | Bennett | 450/85 |
| 2,022,317 | A | * | 11/1935 | Kemp | 450/85 |
| 2,052,707 | A | * | 9/1936 | Haimoff | 450/61 |
| 2,118,378 | A | * | 5/1938 | Graham | 2/328 |
| 2,156,478 | A | * | 5/1939 | Kemp | 450/85 |
| 2,445,449 | A | * | 7/1948 | Moon | 450/59 |
| 2,455,036 | A | * | 11/1948 | Boylan | 450/86 |
| 2,581,036 | A | * | 1/1952 | McIlhinney | 450/2 |
| 2,626,395 | A | * | 1/1953 | Whitman | 450/28 |
| 3,008,468 | A | * | 11/1961 | Williams | 450/2 |
| 3,027,898 | A | * | 4/1962 | Williams | 450/86 |
| 3,409,017 | A | * | 11/1968 | Ramsell | 450/62 |
| 3,419,895 | A | * | 12/1968 | Stephensen | 450/60 |
| 3,439,682 | A | * | 4/1969 | Defru | 450/36 |
| 3,491,762 | A | * | 1/1970 | Simonsen | 450/60 |
| 3,623,487 | A | * | 11/1971 | Chiu | 450/43 |
| 3,642,009 | A | * | 2/1972 | Nobbs | 450/60 |
| 3,698,399 | A | * | 10/1972 | Hand | 450/59 |
| 3,769,987 | A | * | 11/1973 | Markowitz | 450/60 |
| 4,276,884 | A | * | 7/1981 | O'Daniels | 450/86 |
| 5,823,851 | A | * | 10/1998 | Dicker | 450/2 |
| 5,863,236 | A | * | 1/1999 | Johnson | 450/62 |
| 6,110,007 | A | * | 8/2000 | Rittmann | 450/86 |

* cited by examiner

*Primary Examiner*—Gloria Hale
(74) *Attorney, Agent, or Firm*—Patents + TMS, P.C.

(57) ABSTRACT

A bra and a system have bays and a truss for supporting breasts of a user wearing the bra. The bra has a first bay and/or a second bay for receiving the breasts of the user wearing the bra. The bra has a first cup, a second cup and/or the truss for supporting and/or for enclosing the breasts of the user. The truss connects a rear end of the first portion to a rear end of the second portion. Liners are connected to an interior surface of the first portion and/or an interior surface of the second portion. The truss reduces stress of, strain of and/or pain in shoulders, a neck and/or a back of the user from the weight of the breasts of the user. The bays, the truss and/or the cups of the bra minimize unwanted movements of the breast of the user.

20 Claims, 2 Drawing Sheets

10
12
14
16
18
20
22
23
24
25
26
28
30
32
34
36
38
40
42
44
46
48
50a
50b
52a
52b
54a
54b
56
III
IV

BRA AND SYSTEM HAVING A BAY AND A TRUSS AND METHOD FOR USING THE SAME

BACKGROUND OF THE INVENTION

The present invention generally relates to a bra and a system having a bay and a truss and a method for using the same. More specifically, the present invention relates to a bra and a system having a bay and a truss and a method for manufacturing the same which may have a liner connected to cups of the bra. The liner may be connected to an interior surface of the cups of the bra to define the bay of the cups of the bra. The bay of the cups may be sized and/or may be shaped to receive a breast of a user which may be wearing the bra. The liner connected to the interior surface may be made from a material, such as, for example, a mesh material, a cloth, a wicking fabric and/or the like. The liner may separate the breast of the user from a body of the user to prevent irritation of the breast and/or skin of the user from heat, sweat and/or fungal growth.

The cups of the bra may have an exterior surface and fasteners connected to a front side of the exterior surface of the cups of the bra. The fasteners may attach the cups of the bra to each other to enclose and/or to surround the breast of the user and/or the body of the user between the cups of the bra and the truss of the bra. The truss of the bra may be attached to a rear side of the bra to connect the cups to each other. The truss may have one or more straps and/or a ring for attaching the rear side of each of the cups of the bra to each other. The truss may displace a weight of breasts of the user over and/or onto an upper-center of mass of the user to prevent and/or to reduce a chronic pain syndrome of, for example, a neck, a shoulder and/or a back of the user. The bay and/or the truss of the bra may restrict, may control, may prohibit and/or may reduce movement of the breasts of the user with respect to the body of the user to prevent muscle strains in, for example, the neck, the shoulder and the back of the user.

It is, of course, generally known to provide a brassiere and/or a bra as an undergarment to support and/or to cover a breast of a user wearing the brassiere and/or the bra. Traditionally, the brassiere and/or the bra has a cup for receiving, for housing and for containing each of the breasts of the user. The brassiere and/or the bra has a shoulder strap and a band to secure the brassiere and/or the bra to the user for supporting one or more of the breasts of the user. The cups of the brassiere and/or the bra may be available in a cup size, such as, for example, an A-cup size, a B-cup size, a C-cup size, a D-cup size and/or the like. The cup size of the brassiere and/or the bra is based on and/or is relative to a volume of the breasts of the user. The band of the brassiere and/or the bra may be available in a band size, such as, for example, 30-size band, a 32-size band, a 38-size band and/or the like. The band size is based on and/or is relative to a circumference of a chest of the user at a bust of the user excluding the breasts of the user.

The band of the brassiere and/or the bra extends around a body of the user under the breasts of the user when the brassiere and/or the bra is worn by the user. The shoulder straps of the brassiere and/or the bra are attached at opposite ends of the brassiere and/or the bra. Arms of the user may be inserted between the brassiere and/or the bra into the shoulder straps to wear the brassiere and/or the bra of the user. The brassiere and/or the bra may pull and/or may lift the brassiere and/or the bra upwardly with respect to the breasts of the user. As a result, the band and/or the shoulder straps of the brassiere and/or the bra may lift the breasts of the user and/or may pull the breasts of the user inwardly with respect to a chest of the user. Traditionally, the cups of the brassiere and/or the bra may have underwires and/or plastic reinforcements for shaping and/or for forming the cups to correspond to a shape of the breasts of the user.

However, a traditional brassiere and/or the bra provides inadequate support and/or comfort for the breasts of the user wearing the brassiere and/or the bra. Additionally, the band and/or the shoulder straps of the brassiere and/or the bra require a neck and/or a shoulder of the user to exert an upward force to support the breasts of the user. As a result, the band and/or the shoulder straps of the user may cause a 'dig in' of the shoulder, the neck and/or the back of the user. As a result, the user may suffer from chronic pain, such as, for example, shoulder pain, neck pain, back pain and/or headaches from wearing the brassiere and/or the bra. The user may seek and/or may receive medical attention, such as, pain relievers, muscle relaxants, physical therapy and/or reduction mammoplasty to treat the chronic pain. Recently, the band and/or the shoulder straps of the brassiere and/or the bra have been widened and/or pads have been attached to the shoulder straps to reduce the 'dig in' of the shoulder, the neck and/or the back of the user. However, the widened band and/or shoulder straps and/or the pads do not reduce and/or prevent the chronic pain of the user.

The underwire and/or the shape of the cups of the brassiere and/or the bra may be uncomfortable and/or inadequate for receiving, for housing and/or for containing the breasts of the user. Further, the cups of the brassiere and/or the bra may 'ride up' with respect to the breasts of the user wearing the brassiere and/or the bra. Still further, the breast may contact an area of skin of the user located adjacent to the breast of the user which may cause heating, sweating and/or fungal growth in the area of skin. Moreover, the cups, the shoulder straps and/or the band of the brassiere and/or the bra may not restrict and/or control movement, such as, for example, jiggling, bouncing and/or flopping of the breasts of the user. As a result, the movement of the breast may cause the user to experience unwanted attention, embarrassment, avoidance of exercise and/or obesity.

A need, therefore, exists for a bra and a system having a bay and a truss and a method for using the same. Additionally, a need exists for a bra and a system having a bay and a truss and a method for using the same which may provide adequate support and comfort for the breasts of the user wearing the bra. Further, a need exists for a bra and a system having a bay and a truss and a method for using the same which may prevent a 'dig in' of the shoulder, of the neck and/or of the back of the user. Still further, a need exists for a bra and a system having a bay and a truss and a method for using the same which may prevent and/or may reduce chronic pains in the neck, the shoulder and/or the back of the user wearing the bra. Moreover, a need exists for a bra and a system having a bay and a truss and a method for using the same which may prevent 'ride up' of the cups of the bra with respect to the breasts of the user when the user is wearing the bra. Furthermore, a need exists for a bra and a system having a bay and a truss and a method for using the same which may restrict, may limit and/or may prevent unwanted movements of the breast of the user wearing the bra.

SUMMARY OF THE INVENTION

The present invention provides a bra and a system having a bay and a truss and a method for using the same. More specifically, the present invention provides a bra and a system having a bay and a truss and a method for using the same which may have a liner attached to an interior surface of cups of the bra. The liner and the cups of the bra may define the bay which may be sized and/or may be shaped to receive a breast of the user. The bay may support the breast of the user to prevent unwanted movements of the breast of the user during movement of a body of the user. The liner may be located between the breast of the user and skin adjacent to the breast of the user when the user is wearing the bra. The liner may be made from a material which may absorb moisture to prevent irritation of the breast of the user and/or the skin of the user.

Each cup of the bra may have a length defined between a front end of the cup and a rear end of the cup. Fasteners may connect the front ends of the cups of the bra. The truss may be connected to and/or may be attached to rear ends of the cups of the bra. The truss may have, for example, one strap, two straps or three straps attaching the cups of the bra. The truss may support the breasts of the user when the user is wearing the bra. The truss may displace the weight of the breasts of the user to an upper center of mass of the user. As a result, the truss may reduce, may prevent and/or may decrease straining of and pain in a shoulder, a neck and/or a back of the user when the user is wearing the bra. The truss may support the breasts of the user within the cups of the bra to reduce unwanted movements of the breasts of the user.

To this end, in an embodiment of the present invention, a bra to be worn by a user wherein the user has a first breast and a second breast wherein the bra is shaped to receive the first breast and the second breast of the user when the user is wearing the bra is provided. The bra has a first portion having a length defined between a front end of the first portion and a rear end of the first portion wherein the first portion has a first base and a first cup wherein the first portion has a height defined between the first base of the first portion and the first cup of the first portion wherein the first cup is sized to enclose the first breast of the user when the user is wearing the first portion wherein the first portion has an exterior surface of the first portion and an interior surface of the first portion wherein the interior surface of the first portion is located in a position opposite to the exterior surface of the first portion. Further, the bra has a second portion having a length defined between a front end of the second portion and a rear end of the second portion wherein the second portion has a second base and a second cup wherein the second portion has a height defined between the second base of the second portion and the second cup of the second portion wherein the second cup is sized to enclose the second breast of the user when the user is wearing the second portion wherein the second portion has an exterior surface of the second portion and an interior surface of the second portion wherein the interior surface of the second portion is located in a position opposite to the exterior surface of the second portion. Still further, the bra has a liner connected to the interior of the first portion wherein the liner is made from an absorbent material. Moreover, the bra has a truss having a band size defined between a first end of the truss and a second end of the truss wherein the truss is connected to the rear side of the first portion and the rear side of the second portion wherein the truss is attached to the first base of the first portion, the first cup of the first portion, the second base of the second portion and the second cup of the second portion wherein the first portion is connected to the second portion via the truss.

In an embodiment, the bra has a fastener connected to the front end of the first portion and the front end of the second portion wherein the first portion is connected to the second portion via the fastener.

In an embodiment, the truss has a ring which connects the rear end of the first portion and the rear end of the second portion.

In an embodiment, the bra has an adjuster connected to the truss wherein the band size of the truss is changed with the adjuster.

In an embodiment, the liner and the interior surface of the first portion define a bay which is sized to enclose the first breast of the user when the user is wearing the first portion.

In an embodiment, the truss is integrally formed with the first portion and the second portion.

In an embodiment, the truss is made from a stretchable material.

In another embodiment of the present invention, a system to be worn by a user wherein the user has a first breast and a second breast wherein the system is sized to enclose the first breast and the second breast of the user when the user is wearing the system is provided. The system has a bra having an exterior surface and an interior surface wherein the interior surface of the bra is located in a position opposite to the exterior surface of the bra wherein the bra has a band size, a first cup and a second cup wherein the first cup has a first end and a second end wherein the second end of the first cup is located in a position opposite to the first end of the first cup wherein the second cup has first end and a second end wherein the second end of the second cup is located in a position opposite to the first end of the second cup wherein the second end of the first cup is connected to the second end of the second cup. Further, the system has a first liner having a length defined between a first end of the first liner and a second end of the first liner wherein the first end of the first liner is connected to the interior surface of the bra wherein the second end of the first liner is adjacent to the first cup of the bra wherein the interior surface of the bra and the first liner define a first bay wherein the first bay is located between the first liner and the first cup of the bra wherein the first bay is sized to receive the first breast of the user when the user is wearing the bra wherein the first breast of the user is insertable into the first bay via the second end of the first liner when the user is wearing the bra wherein the first breast of the first user is located within the bay between the first liner and the first cup of the bra when the user is wearing the bra. Still further, the system has a second liner connected to the interior surface of the bra wherein the second liner is adjacent to the second cup of the bra wherein the interior surface of the bra and the second liner define a second bay which is sized to receive the second breast of the user when the user is wearing the bra wherein the second breast of the user is located between the second cup of the bra and the second liner when the user is wearing the bra.

In an embodiment, the system has a truss having a length defined between a first end of the truss and a second end of the truss wherein the second end of the first cup is connected to the second end of the second cup via the truss.

In an embodiment, the first liner is made from an absorbent material.

In an embodiment, the system has a ring connected to the first cup and the second cup wherein the ring is adjacent to the second end of the first cup and the second end of the second cup.

In an embodiment, the system has a fastener connecting the first cup and the second cup wherein the fastener is attached to the exterior surface of the bra.

In an embodiment, the system has a strap connected to the bra wherein the strap has a length defined between a first end and a second end wherein the length of the strap is adjustable.

In an embodiment, the system has an adjuster connected to the bra wherein the band size of the bra is changed with the adjuster.

In another embodiment of the present invention, a method for supporting a first breast and a second breast of a user is provided. The method has the step of providing a bra having an exterior surface of the bra and an interior surface wherein the interior surface of the bra is located in a position opposite to the exterior surface of the bra wherein the bra has a first cup and second cup wherein the first cup has a first end of the first cup and a second end of the first cup which is located in a position opposite to first end of the first cup wherein the second cup has a first end of the second cup and a second end of the second cup which is located in a position opposite to the first end of the second cup wherein the bra has a truss connecting the second end of the first cup to the second end of the second cup wherein the truss has a band size extending from the first cup to the second cup. Further, the method has the step of connecting a first liner to the interior surface of the bra wherein the first liner is adjacent to first cup of the bra wherein the first liner has a length defined between a first end of the first liner and a second end of the first liner wherein the first end of the first liner is attached to the interior surface of the bra wherein the second end of the first liner is separated from the interior surface of the bra wherein the interior of the bra and the first liner define a first bay wherein the first bay is sized to receive the first breast of the user when the user is wearing the bra wherein the second cup is sized to enclose the second breast of the user when the user is wearing the bra wherein the first liner is made from an absorbent material wherein the first breast of the user is located between the first liner and the interior surface of the bra when the user is wearing the bra.

In an embodiment, the method has the step of connecting a second liner to the bra wherein the second liner and the interior surface of the bra define a second bay which is sized to receive the second breast of the user.

In an embodiment, the method has the step of attaching the first end of the first cup to the first end of the second cup.

In an embodiment, the method has the step of changing the band size of the truss.

In an embodiment, the method has the step of attaching a shoulder strap to the bra wherein the shoulder strap and the truss support the first breast and the second breast of the user when the user is wearing the bra.

In an embodiment, the method has the step of connecting a ring to the truss wherein the ring is located between the first cup of the bra and the second cup of the bra.

It is, therefore, an advantage of the present invention to provide a bra and a system having a bay and a truss and a method for using the same.

Another advantage of the present invention is to provide a bra and a system having a bay and a truss and a method for using the same which may have one or more straps and/or a ring for connecting a rear end of a first portion of the bra to a rear end of a second portion of the bra.

Yet another advantage of the present invention is to provide a bra and a system having a bay and a truss and a method for using the same which may have a hook and loop fastener, hooks, ties, slides, buttons, a zipper and/or the like to connected a front end of a first portion of the bra to a front end of a second portion of the bra A still further advantage of the present invention is to provide a bra and a system having a bay and a truss and a method for using the same which may be made from, for example, cloth and/or a wicking material to be a rash retardant for increasing comfort when wearing the bra and/or for decreasing a frequencies of medical visits to treat rashes associated with wearing the bra.

Another advantage of the present invention is to provide a bra and a system having a bay and a truss and a method for using the same which may prevent, restrict and/or control movements of a breast of a user wearing the bra.

Yet another advantage of the present invention is to provide a bra and a system having a bay and a truss and a method for using the same which may have a liner to define the bay of the bra for receiving and/or for housing a breast of a user wearing the bra.

Yet another advantage of the present invention is to provide a bra and a system having a bay and a truss and a method for using the same which may decrease pain associated with a neck, a shoulder and/or a back of a user wearing the bra.

Another advantage of the present invention is to provide a bra and a system having a bay and a truss and a method for using the same which may reduce a necessity for and/or a desire for breast reduction surgery by a user wearing the bra.

And, another advantage of the present invention is to provide a bra and a system having a bay and a truss and a method for using the same which may increase a frequency of participation by a user in aerobic activity when the user is wearing the bra.

Still further, an advantage of the present invention is to provide a bra and a system having a bay and a truss and a method for using the same which may decrease utilization of a physical therapy and/or medication management for chronic pain and/or strains of a neck, a shoulder and/or a back of a user from wearing the bra.

Yet another advantage of the present invention is to provide a bra and a system having a bay and a truss and a method for using the same which may encapsulate a breast of a user of the bra to increase comfort of the user by supporting an inferior portion, a medial portion and/or a lateral portion of the breast of the user wearing the bra.

A still further advantage of the present invention is to provide a bra and a system having a bay and a truss and a method for using the same which may lift and separate breasts of a user from a body of the user to increase comfort of the user wearing the bra.

Another advantage of the present invention is to provide a bra and a system having a bay and a truss and a method for using the same which may provide an adjuster associated with the truss of the bra to increase comfort of the user wearing the bra.

A still further advantage of the present invention is to provide a bra and a system having a bay and a truss and a method for using the same which may displace a weight of breasts of a user to an upper-body center of mass of the user for supporting the breasts of the user.

Yet another advantage of the present invention is to provide a bra and a system having a bay and a truss and a method for using the same which may provide a harness with the truss for comfortably supporting breasts of a user when wearing the bra.

Another advantage of the present invention is to provide a bra and a system having a bay and a truss and a method for using the same which may prevent 'dig in' of shoulders and/or a neck of a user from a weight of breasts of the user.

And, another advantage of the present invention is to provide a bra and a system having a bay and a truss and a method for using the same which may decrease heat, sweating and/or rashing of a breast and/or skin of the user adjacent to the breast of the user wearing the bra.

Still further, an advantage of the present invention is to provide a bra and a system having a bay and a truss and a method for using the same which may provide cups of the bra which are molded, non-molded, seamed, seamless, padded and/or unpadded for wearing by a user of the bra.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a bra and a system having a bay and a truss and a method for using the same. The bra may have a first cup and a second cup for supporting breasts of a user when the user is wearing the bra. A fastener may attach and/or may connect a front end of the first cup of the bra to a front end of a second cup of the bra. The truss may attach and/or may connect a rear end of the first cup of the bra to a rear end of the second cup of the bra. A liner may be attached and/or may be connected to an interior surface of the first cup and/or the second cup of the bra. The liner and the interior surface of the first cup and/or the second cup may define the bay in the first cup and/or the second cup, respectively. The bay of the first cup and/or the second cup may be sized and/or may be shaped to receive a breast of the user wearing the bra.

The liner may prevent irritation of the breast of the user and/or of skin of the user adjacent to the breast of the user. As a result, the liner may prevent heating, sweating and/or fungal growth on the breasts and/or on the skin adjacent to the breasts of the user. The truss may prevent stress of, strain of and/or pain in a shoulder, a neck and/or a back of the user. The bay, the truss, the first cup and/or the second cup of the bra may prevent, may reduce and/or may control unwanted movement of the breast of the user wearing the bra.

Figures 1, 2, 3, 4:
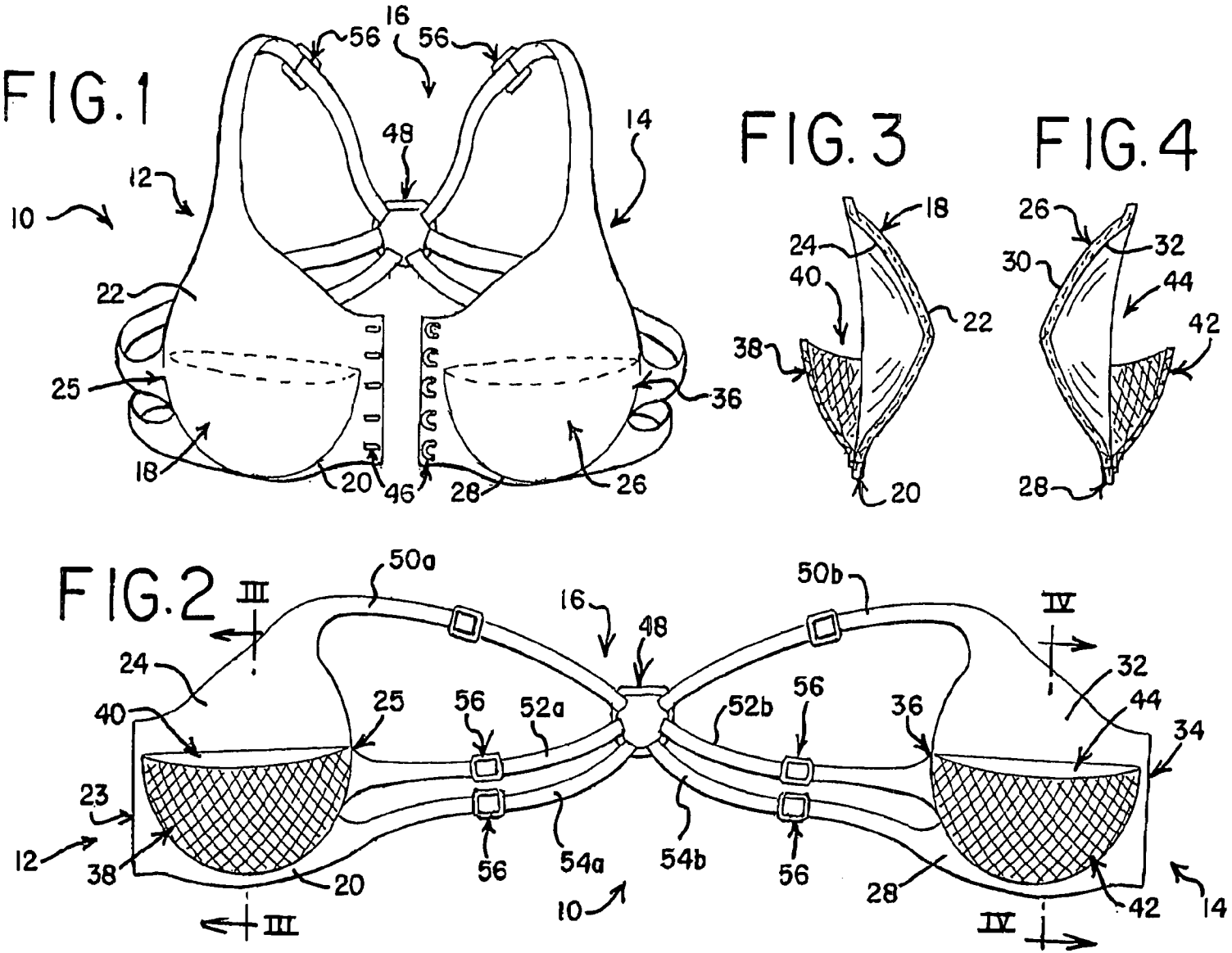
FIG. 1 illustrates a front plan view of a bra having a bay and a truss in an embodiment of the present invention.
FIG. 2 illustrates a back plan view of a bra having a bay and a truss in an embodiment of the present invention.
FIG. 3 illustrates a cross-sectional view of a first portion of a bra having a bay in another embodiment of the present invention.
FIG. 4 illustrates a cross-sectional view of a second portion of a bra having a bay in another embodiment of the present invention.

Referring now to the drawings wherein like numerals refer to like parts, FIGS. 1 and 2 illustrate a bra 10 in an embodiment of the present invention. The bra 10 may have a first portion 12 connected to and/or attached to a second portion 14 with a truss 16. In an embodiment, the bra 10 may be, for example, a built-in bra, a bullet bra, a demi bra, a full support bra, a mastectomy bra, a maternity bra, a minimizer bra, a nursing bra, a padded bra, a convertible bra, an abalconette bra, a push-up bra, a shelf bra, a sports bra, a strapless bra or a T-shirt bra. In an embodiment, the bra 10 may be worn as, for example, swimwear, sleepwear, lingerie, a halter top and/or the like. The present invention should not be deemed as limited to a specific embodiment of the bra 10.

The first portion 12 and/or the second portion 14 of the bra 10 may be made from a first material, such as, for example, a fabric, a cotton, a lace and/or the like. In an embodiment, the first portion 12 and/or the second portion 14 may be made from an stretchable fabric, an absorbent fabric, a synthetic fiber, such as, for example, spandex, elastane and/or the like. It should be understood that the first material of the first portion 12 and/or the second portion 14 of the bra 10 may be any material as known to one having ordinary skill in the art.

The first portion 12 may have a first cup 18 and/or a first base 20. The first cup 18 may be attached to, may be affixed to, may be integrally formed with and/or may be connected to the first base 20 of the first portion 12. The first portion 12 may have an exterior surface 22 and/or an interior surface 24 located opposite to the exterior surface 22 of the first portion 12. The first portion 12 may have a front end 23 and/or a rear end 25 located opposite to the front end 23 of the first portion 12.

The second portion 14 may have a second cup 26 and/or a second base 28. The second cup may be attached to, may be affixed to, may be integrally formed with and/or may be connected to the second base 28. The second portion 14 may have an exterior surface 30 and/or an interior surface 32 located opposite to the exterior surface 30. The second portion 14 may have a front end 34 and/or a rear end 36 located opposite to the front end 34 of the second portion 14.

The first cup 18 and/or the second cup 26 may be sized into, may be formed into and/or may be shaped into a cup size, such as, for example, an A-cup size, a B-cup size, a C-cup size, a D-cup size and/or the like. The cup size of the first cup 18 and/or the second cup 20 may be based on, may correspond to and/or may relative to a volume of a breast of a user (not shown in the figures). In an embodiment, the first cup 18 and/or the second cup 26 may be, for example, a molded cup, a non-molded cup, a seamed cup, a seamless cup, a padded cup and/or the like. It should be understood that the cup size of the first cup 18 of the bra 10 and/or the second cup 26 of the bra 10 may be any cup size as known to one of ordinary skill in the art.

As shown in FIGS. 2-4, a first liner 38 may be attached to, may be affixed to, may be connected to and/or may be integrally formed with the interior surface 24 of the first cup 18 of the first portion 12. A second liner 42 may be attached to, may be affixed to, may be connected to and/or may be integrally formed with the interior surface 32 of the second cup 26 of the second portion 14. In an embodiment, the first liner 38 and/or the second liner 42 may be made from a second material, such as, for example, a cloth, a mesh material, an exercise fabric, a wicking fabric, an absorbent fabric and/or the like. In an embodiment, the second material of the first liner 38 and/or the second liner 42 may absorb and/or may wick sweat, water, moisture and/or the like. In an embodiment, the second material of the first liner 38 and/or the second liner 42 may be made from, for example, a material which may be a rash retardant and/or the like.

The first liner 38 may extend from the rear end 25 of the first portion 12 to the front end 23 of the first portion 12. The first liner 38 may be located adjacent to the first base 20 of the first portion 12 and/or may extend inwardly from the first base 20 into the first cup 18 of the first portion 12. The second liner 42 may extend from and/or between the rear end 36 of the second portion 14 to the front end 34 of the second portion 14. The second liner 42 may be located adjacent to the second base 28 of the second portion 14 and/or may extend inwardly from the second base 28 into the second cup 26 of the second portion 14.

The first liner 38 and/or the interior surface 24 of the first cup 18 may form and/or may define a first bay 40 within the first cup 18 of the first portion 12. The second liner 42 and/or the interior surface 32 of the second cup 26 may form and/or may define a second bay 44 within the second cup 26 of the second portion 14. The first bay 40 and/or the second bay 44 may be sized to and/or may be shaped to receive, to enclose, to house and/or to contain the breast of the user wearing the bra 10. As a result, the breast of the user may be inserted into and/or may be placed within the first bay 40 and/or the second bay 44 when the bra 10 may be worn by the user.

The exterior surface 22 of the first portion 12 and/or the exterior surface 30 of the second portion 14 may have fasteners 46. The fasteners 46 may be attached to, may connected to, may be affixed to and/or may be integrally formed with the first portion 12 of the bra 10 and/or the second portion 14 of the bra 10. The fasteners 46 may be located adjacent to the front end 23 of the first portion 12 and/or the front end 34 of the second portion 12. The fasteners 46 may attach and/or may connect the first portion 12 of the bra 10 to the second portion 14 of the bra 10. The fasteners 46 may be, for example, hooks, eyelets, a zipper, ties, slides, buttons and/or the like. In an embodiment, the front end 23 of the first portion 12 may be attached to, may be connected to, may be affixed to and/or may be integrally formed with the front end 34 of the second portion 14. It should be understood that the fasteners 46 may be any fasteners capable of connecting the first portion 12 and the second portion 14 as known to one of ordinary skill in the art.

The truss 16 may be attached to, may be connected to, may be affixed to and/or may be integrally formed with the first portion 12 and/or the second portion 14. The truss 16 may be located between the rear end 25 of the first portion 12 and the rear end 36 of the second portion 14. In an embodiment, the truss 16 may have a configuration, such as, for example, a two strap configuration, a three strap configuration or a strapless configuration. The present invention should not be deemed as limited to a specific embodiment of the configuration of the truss 16.

As shown in FIGS. 1 and 2, the truss 16 may have the three strap configuration with a first shoulder strap 50*a*, a second shoulder strap 50*b*, a first upper strap 52*a*, a second upper strap 52*b*, a first lower strap 54*a* and/or a second lower strap 54*b* which may be located adjacent to the rear end 25 of the first portion 12 and/or the rear end 36 of the second portion 14. The first shoulder strap 50*a* and/or the second shoulder strap 50*b* (collectively known hereinafter as "the shoulder straps 50*a*, 50*b*") may be connected, may be attached to, may be affixed to and/or may be integrally formed with the first cup 18 of the first portion 12 and/or the second cup 26 of the second portion 14, respectively. Further, the first upper strap 52*a* and/or the second upper strap 52*b* (collectively known hereinafter as "the upper straps 52*a*, 52*b*") may be attached to, may be connected to, may be affixed to and/or may be integrally formed with the first cup 18 of the first portion 12 and/or the second cup 26 of the second portion 14, respectively. Moreover, the first lower strap 54*a* and/or the second lower strap 54*b* (collectively known hereinafter as "the lower straps 54*a*, 54*b*") may be attached to, may be connected to, may be affixed to and/or may be integrally formed with the first base 20 of the first portion 12 and/or the second base 28 of the second portion 14, respectively.

The truss 16 may have a ring 48 located between the shoulder straps 50*a*, 50*b*, the upper straps 52*a*, 52*b* and/or the lower straps 54*a*, 54*b*. The shoulder straps 50*a*, 50*b*, the upper straps 52*a*, 52*b* and/or the lower straps 54*a*, 54*b* may be attached to and/or may be connected to the ring 48 of the truss 16. As a result, the rear end 25 of the first portion 12 may be attached and/or may be connected to the rear end 36 of the second portion 14 via the ring 48.

Each of the shoulder straps 50*a*, 50*b*, the upper straps 52*a*, 52*b* and/or the lower straps 54*a*, 54*b* may have an adjuster 56 for changing, for adjusting and/or for altering a length of the shoulder straps 50*a*, 50*b*, the upper straps 52*a*, 52*b* and/or the lower straps 54*a*, 54*b*. The length of the shoulder straps 50*a*, 50*b*, the upper straps 52*a*, 52*b* and/or the lower straps 54*a*, 54*b* may be increased and/or may be decreased via the adjuster 56 of the length of the shoulder straps 50*a*, 50*b*, the upper straps 52*a*, 52*b* and/or the lower straps 54*a*, 54*b*, respectively.

The length of the shoulder straps 50*a*, 50*b*, the upper straps 52*a*, 52*b* and/or the lower straps 54*a*, 54*b* may have a band size of the truss 16. The band size of the truss 16 may be, for example, a 30-size band, a 32-size band, a 36-size band and/or the like. The band size of the truss 16 may be based on, may correspond to and/or may be relative to a circumference of a chest of the user at a bust of the user. In an embodiment, the length of the shoulder straps 50*a*, 50*b*, the upper straps 52*a*, 52*b* and/or the lower straps 54*a*, 54*b* may be changed from a 30-size band to a 36-size band via the adjuster 56 of each of the shoulder straps 50*a*, 50*b*, the upper straps 52*a*, 52*b* and/or the lower straps 54*a*, 54*b*. As a result, the band size of the truss 16 may be adjusted to correspond to the circumference of the chest of the user via the adjuster 56 of each of the shoulder straps 50*a*, 50*b*, the upper straps 52*a*, 52*b* and/or the lower straps 54*a*, 54*b*. Moreover, the band size of the truss 16 may be increased to receive the breasts of the user when the user may be retaining water and/or the like. The present invention should not be deemed as limited to a specific embodiment of the band size of the truss 16.

Figure 5:
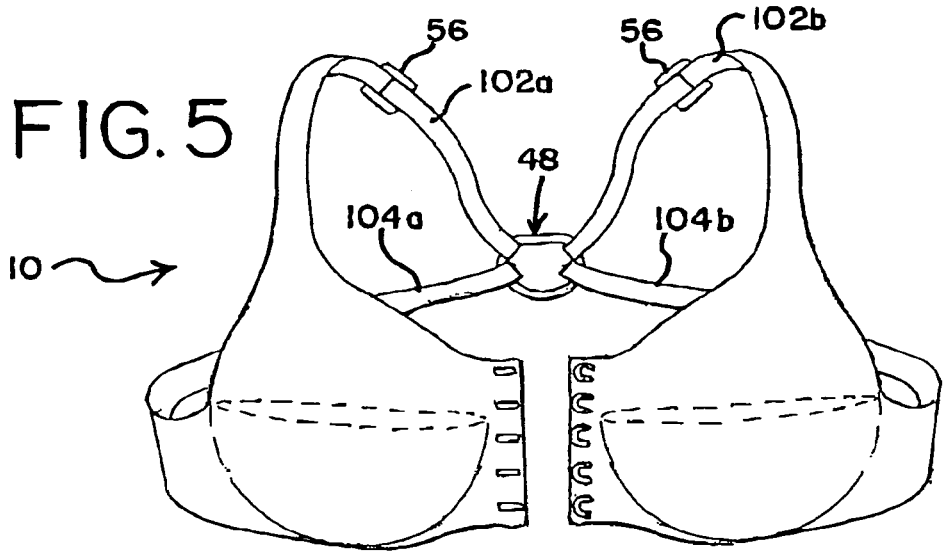
FIG. 5 illustrates a front plan view of a truss for a bra in an embodiment of the present invention.

The ring 48 may be made from a third material, such as, for example, a polyethylene, steel, cloth, a fabric and/or the like. The ring 48 may have a perimeter shape, such as, for example, a U-shape (as shown in FIG. 2), a circular shape (as shown in FIG. 5), a rectangular shape, an oval shape, a triangular shape, polygonal shape and/or the like. It should be understood that the present invention should not be deemed as limited to a specific embodiment of the third material of the ring 48 and/or the perimeter shape of the ring 48.

As shown in FIG. 5, the truss 16 may have, for example, the two strap configuration with a first top strap 102*a*, a second top strap 102*b*, a first bottom strap 104*a* and/or a second bottom strap 104*b*. The first top strap 102*a* may be connected to, may be attached to, may be affixed to and/or may be integrally formed with the first cup 18 of the first portion 12. The first bottom strap 104*a* may be connected to, may be attached to, may be affixed to and/or may be integrally formed with the first base 20 of the first portion 12. The second top strap 102*b* may be connected to, may be attached to, may be affixed to and/or may be integrally formed with the second cup 26 of the second portion 14. The second bottom strap 104*b* may be connected to, may be attached to, may be affixed to and/or may be integrally formed with the second base 28 of the second portion 14.

Each of the first top strap 102*a*, the second top strap 102*b*, the first bottom strap 104*a* and/or the second bottom strap 104*b* may be connected and/or may be attached to the ring 48. As a result, the first portion 12 may be attached to and/or may be connected to the second portion 14 via the ring 48, the first top strap 102*a*, the second top strap 102*b*, the first bottom strap 104*a* and/or the second bottom strap 104*b*.

Figure 6:
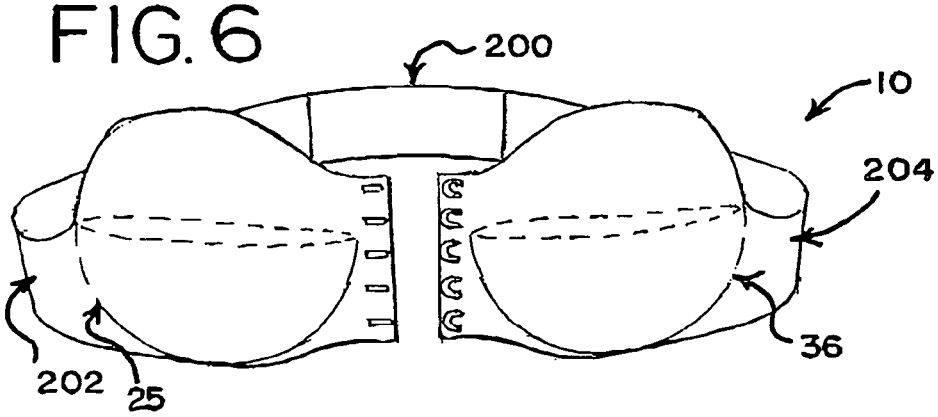
FIG. 6 illustrates a front plan view of a truss for a bra in an embodiment of the present invention.

In an embodiment, the truss 16 may have a band 200 which may have a first end 202 and/or a second end 204 located opposite to the first end 202 of the band 200 as shown in FIG. 6. The first end 202 of the band 200 may be attached to, may be connected to, may be affixed to and/or may be integrally formed with the rear end 25 of the first portion 12, the first cup 18 of the first portion and/or the first base 20 of the first portion 12. The second end 204 of the band 200 may be attached to, may be connected to, may be affixed to and/or may be integrally formed with the rear end 36 of the second portion 14, the second cup 26 of the second portion 14 and/or the second base 28 of the second portion 14. As a result, the first portion 12 may be attached to, may be connected to and/or may be affixed to the second portion 14 via the band 200.

Figure 7:
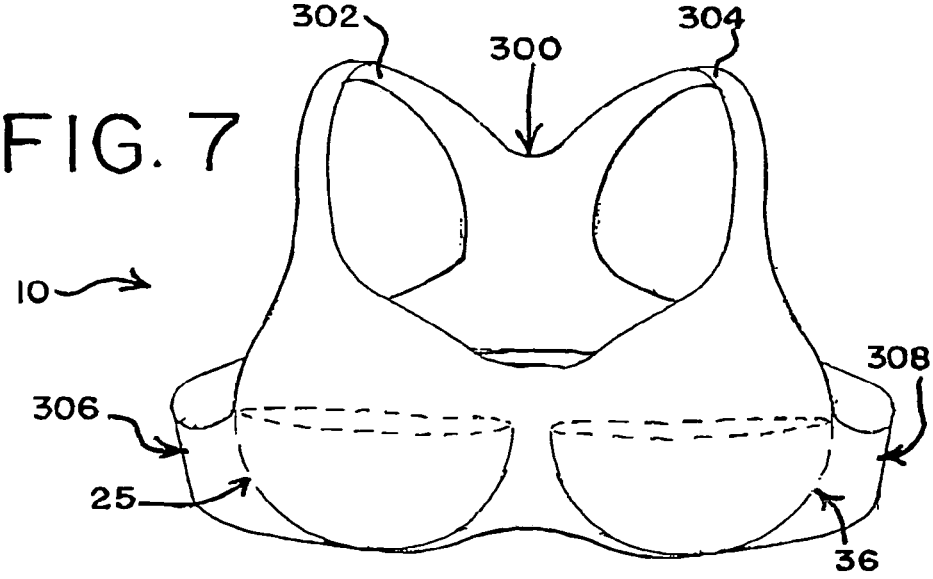
FIG. 7 illustrates a front plan view of a truss for a bra in an embodiment of the present invention.

In an embodiment, the truss may have a band 300, a first shoulder strap 302 and/or a second shoulder strap 304 as shown in FIG. 7. The band 300 may have a first end 306 and/or a second end 308 located opposite to the first end 306 of the band 300. The first shoulder strap 302 and/or the second shoulder strap 304 (collectively known hereinafter as "the shoulder straps 302, 304") may be attached to, may be connected to, may be affixed to and/or may be integrally formed with the band 300. In an embodiment, the shoulder straps 302, 304 may be connected to, may be attached to and/or may be affixed to the band 300 via the ring 48.

The first end 306 of the band 300 may be connected to, may be attached to, may be affixed to and/or may be integrally formed with the rear end 25 of the first portion 12, the first cup 18 of the first portion and/or the first base 20 of the first portion 12. The second end 308 of the band 300 may be attached to, may be connected to, may be affixed to and/or may be integrally formed with the rear end 36 of the second portion 14, the second cup 26 of the second portion 14 and/or the second base 28 of the second portion 14.

The first shoulder strap 302 of the band 300 may be attached to, may be connected to, may be affixed to and/or may be integrally formed with the first cup 18 of the first portion 12. The second shoulder strap 302 of the band 300 may be attached to, may be connected to, may be affixed to and/or may be integrally formed with the second cup 26 of the second portion 14. As a result, the first portion 12 may be attached to, may be connected to and/or may be affixed to the second portion 14 via the band 300 and/or the shoulder straps 302, 304 of the band 300.

In an embodiment, each of the shoulder straps 50*a*, 50*b*, the upper straps 52*a*, 52*b* and/or the lower straps 54*a*, 54*b* may be made from the first material and/or the second material. In an embodiment, each of the first top strap 102*a*, the second top strap 102*b*, the first bottom strap 104*a* and/or the second bottom strap 104*b* may be made from the first material and/or the second material. In an embodiment, the band 200 and/or the band 300 may be made from the first material and/or the second material.

The user may have a first arm and/or a second arm which may be inserted into the shoulder straps 50*a*, 50*b* and/or the shoulder straps 302, 304 to wear the bra 10. The shoulder straps 50*a*, 50*b*, the upper straps 52*a*, 52*b* and/or the lower straps 54*a*, 54*b* may be wrapped around the bust of the user and/or a mid-section of the user to wear the bra 10 having the three strap configuration. The top straps 102*a*, 102*b* and the bottom straps 104*a*, 104*b* may wrap around the bust of the user and/or the mid-section of the user to wear the bra 10 having the two strap configuration. The band 200 and/or the band 300 may be wrapped around the bust of the user and/or the mid-section of the user to wear the bra having the strapless configuration and/or a sports bra configuration, respectively.

The user may insert, may position, may place and/or may locate a first breast of the user within the first bay 40 of the first portion 12. The first bay 40 may be sized to and/or may be shaped to receive, to house, to enclose and/or to contain the first breast of the user. As a result, the first breast of the user may be located and/or positioned within the first bay 40 between the interior surface 24 of the first cup 18 and the liner 38 of the first portion 12. The liner 38 may be located between and/or may be positioned between the first breast of the user and a first area of skin of the user adjacent to the first breast of the user. The first area of skin of the user may be located underneath the first breast of the user.

The user may insert, may position, may place and/or may locate a second breast of the user within the second bay 44 of the second portion 14. The second bay 44 may be sized to and/or may be shaped to receive, to house, to enclose and/or to contain the second breast of the user. As a result, the second breast of the user may be located and/or positioned within the second bay 44 between the interior surface 32 of second cup 26 and the liner 42 of the second portion 14. The liner 42 may be located between and/or may be positioned between the second breast of the user and a second area of skin of the user adjacent to the first breast of the user. The second area of skin of the user may be located underneath the second breast of the user.

The user may connect and/or may attach the front end 23 of the first portion 12 of the bra 10 to the front end 34 of the second 14 of the bra 10 via the fasteners 46. As a result, the truss 16, the first portion 12 and/or the second portion 14 of the bra 10 may encircle, may enclose, may wrap around and/or may surround the user. The user may wear the bra 10 to support the first breast of the user and/or the second breast of the user. The first bay 40 and/or the second bay 44 may enclose and/or may encapsulate the first breast and/or the second breast (collectively known hereinafter as "the breasts), respectively, of the user to support the breasts of the user during movement and/or activities. The first liner 38 and/or the second liner 42 (collectively known hereinafter as "the liners 38, 42) of the bra 10, the first cup 18 and/or the second cup 26 (collectively known hereinafter as "the cups 18, 26") of the bra may support inferior surfaces, medial surfaces and/or lateral surfaces of the breasts of the user wearing the bra 10.

The truss 16, the first portion 12 and/or the second portion 14 may support the breasts of the user in an upward direction and/or an inward direction with respect to the mid-section of the user. The truss 16, the first portion 12 and/or the second portion 14 may displace a weight of the breasts of the user from a neck and/or a shoulder of user. The bra 10 may prevent, may reduce and/or may limit 'dig in' of the shoulder, the neck and/or a back of the user by displacing the weight of the breasts of the user over a body of the user via the truss 16. Moreover, the bra 10 may displace the weight of the breasts of the user to an upper center of mass of the body of the user adjacent to the back of the user. As a result, the bra 10 may prevent, may reduce and/or may minimize a chronic muscle pain and/or a chronic skeletal pain (collectively known hereinafter as "chronic pains") in the body of the user caused from 'dig in of the shoulder and/or the neck of the user. The bra 10 may reduce and/or may minimize the chronic pains, such as, for example, shoulder pains, shoulder strains, neck pains, neck strains, back pains and/or headaches of the user. Preventing the chronic pains of the user wearing the bra 10 may reduce a need and/or a desire of the user to have a surgery, such as, for example, a breast reduction surgery. The present invention should not be deemed as limited to a specific embodiment of the chronic pains which may be prevented by wearing the bra 10.

The bra 10 may prevent, may reduce, may control and/or may minimize unwanted movements, such as, for example, jiggling, bouncing and/or flopping of the breasts of the user when the user is wearing the bra 10. The bra 10 may reduce a frequency and/or a severity of unwanted movements of the breasts of the user to prevent embarrassment of the user during aerobic activity, such as, for example, walking, running, jumping, jogging, dancing, biking and/or the like. As a result, the user may wear the bra 10 and/or may participate in the aerobic activity to prevent unwanted movements of and/or discomfort in the breasts of the user wearing the bra 10. It should be understood that the present invention is not deemed as limited to a specific embodiment of the aerobic activity.

The liners 38, 42 of the first portion 12 and/or the second portion 14, respectively, may be located between the breasts of the user and the mid-section of the user. The liners 38, 42 of the bra 10 may absorb moisture, water and/or sweat from the user and/or the breasts of the user. As a result, the liners 38, 42 of the bra 10 may reduce, may prevent and/or may minimize irritation of, sweating of and/or fungal growth beneath the breasts of the user and/or on the first area of skin and/or the second area of skin of the user. The liners 38, 42 of the bra 10 may prevent and/or may decrease a formation of a rash on the breasts of the user, the first area of skin and/or the second area of skin of user to increase comfort of the user wearing the bra 10.

In an embodiment, a powder (not shown in the figures) may be applied to the liners 38, 42 of the bra 10, the interior surface 24 of the first portion 12 of the bra 10 and/or the interior surface 32 of the second portion 14. The powder may be located and/or may be positioned within the first bay 40 and/or the second bay 44 of the bra 10. The powder may be, for example, baby powder, an astringent powder, a scented talc powder, a unscented talc powder and/or the like. The powder may increase a dryness of the breasts of the user wearing the bra 10 to prevent irritation of the breasts of the user, the first area of skin of the user and/or the second area of skin of the user. The present invention should not be deemed as limited to a specific embodiment of the powder of the bra 10.

The weight of the first breast of the user may push against the interior surface 24 of the first portion 12 and/or the liner 38 of the first portion 12 when the user may be wearing the bra 10. The weight of the second breast of the user may push against the interior surface 32 of the second portion 14 and/or the liner 42 of the second portion when the user may be wearing the bra 10. The weight of the breasts of the user against the first portion 12 and/or the second portion 14 may prevent the cups 18, 26 of the bra 10 from moving upward and/or from 'riding up' with respect to the breasts of the user. As a result, the bra 10 may prevent the 'riding up' of the cups 18, 26 with respect to the breasts of the user to increase support of the breasts of the user wearing the bra 10. Moreover, the bra 10 may prevent and/or may reduce irritation of the breasts of the user, the first area of skin of the user and/or the second area of skin of the user which may be caused from the 'riding up' of the cups 18, 26 with respect to the breasts of the user.

The bra 10 may have the first bay 40 of the first portion 12 and/or the second bay 44 of the second portion 14 for receiving and/or for enclosing the breasts of the user. The cups 18, 26 and/or the truss 16 may support the breasts of the user when the user may be wearing the bra 10. The liners 38, 42 may be attached to and/or may be connected to the interior surface 24 of the first portion 12 and/or the interior surface 32 of the second portion 14 of the bra 10. The liners 38, 42 and the interior surface 24 of the first portion 12 and/or the interior surface 32 of the second portion 14 may define the first bay 40 and/or the second bay 44, respectively. The liners 38, 42 may prevent irritation of and/or rashing of the breasts of the user from moisture and/or the like. The truss 16 may prevent and/or may reduce stress of, strain of and/or pain in the shoulder, the neck and/or the back of the user from the weight of the breasts of the user wearing the bra 10. The first bay 40, the second bay 44, the truss 16, the first cup 18 and/or the second cup 26 may prevent, may reduce and/or may control unwanted movements of the breast of the user wearing the bra 10 during aerobic activities.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A bra to be worn by a user wherein the user has a first breast and a second breast wherein the bra is shaped to receive the first breast and the second breast of the user when the user is wearing the bra, the bra comprising:

a first portion having a length defined between a front end of the first portion and a rear end of the first portion wherein the first portion has a first base and a first cup wherein the first portion has a height defined between the first base of the first portion and the first cup of the first portion wherein the first cup is sized to enclose the first breast of the user when the user is wearing the first portion wherein the first portion has an exterior surface of the first portion and an interior surface of the first portion wherein the interior surface of the first portion is located in a position opposite to the exterior surface of the first portion;

a second portion having a length defined between a front end of the second portion and a rear end of the second portion wherein the second portion has a second base and a second cup wherein the second portion has a height defined between the second base of the second portion and the second cup of the second portion wherein the second cup is sized to enclose the second breast of the user when the user is wearing the second portion wherein the second portion has an exterior surface of the second portion and an interior surface of the second portion wherein the interior surface of the second portion is located in a position opposite to the exterior surface of the second portion;

a liner connected to the interior of the first portion wherein the liner is made from an absorbent material; and a truss having a band size defined between a first end of the truss and a second end of the truss wherein the truss is connected to the rear end of the first portion and the rear end of the second portion wherein the truss is attached to the first base of the first portion, the first cup of the first portion, the second base of the second portion and the second cup of the second portion wherein the first portion is connected to the second portion via the truss.

2. The bra of claim 1 further comprising:

a fastener connected to the front end of the first portion and the front end of the second portion wherein the first portion is connected to the second portion via the fastener.

3. The bra of claim 1 wherein the truss has a ring which connects the rear end of the first portion and the rear end of the second portion.

4. The bra of claim 1 further comprising:

an adjuster connected to the truss wherein the band size of the truss is changed with the adjuster.

5. The bra of claim 1 wherein the liner and the interior surface of the first portion define a bay which is sized to enclose the first breast of the user when the user is wearing the first portion.

6. The bra of claim 1 wherein the truss is integrally formed with the first portion and the second portion.

7. The bra of claim 1 wherein the truss is made from a stretchable material.

8. A system to be worn by a user wherein the user has a first breast and a second breast wherein the system is sized to enclose the first breast and the second breast of the user when the user is wearing the system, the system comprising:

a bra having an exterior surface and an interior surface wherein the interior surface of the bra is located in a position opposite to the exterior surface of the bra wherein the bra has a band size, a first cup and a second cup wherein the' first cup has a first end and a second end wherein the second end of the first cup is located in a position opposite to the first end of the first cup wherein the second cup has first end and a second end wherein the second end of the second cup is located in a position opposite to the first end of the second cup wherein the second end of the first cup is connected to the second end of the second cup;

a first liner having a length defined between a first end of the first liner and a second end of the first liner wherein the first end of the first liner is connected to the interior surface of the bra wherein the second end of the first liner is adjacent to the first cup of the bra wherein the interior surface of the bra and the first liner define a first bay wherein the first bay is located between the first liner and the first cup of the bra wherein the first bay is sized to receive the first breast of the user when the user is wearing the bra wherein the first breast of the user is insertable into the first bay via the second end of the first liner when the user is wearing the bra wherein the first breast of the first user is located within the bay between the first liner and the first cup of the bra when the user is wearing the bra; and a second liner connected to the interior surface of the bra wherein the second liner is adjacent to the second cup of the bra wherein the interior surface of the bra and the second liner define a second bay which is sized to receive the second breast of the user when the user is wearing the bra wherein the second breast of the user is located between the second cup of the bra and the second liner when the user is wearing the bra wherein the first liner and the second liner are constructed from a wicking fabric wherein the wicking fabric wicks moisture away from the first breast and the second breast of the user wherein the wicking fabric is a mesh material wherein the mesh material vents air to the first breast and the second breast to decrease heat adjacent to the first breast and the second breast.

9. The system of claim 8 further comprising:

a truss having a length defined between a first end of the truss and a second end of the truss wherein the second end of the first cup is connected to the second end of the second cup via the truss.

10. The system of claim 8 wherein the first cup is made from a stretchable fabric.

11. The system of claim 8 further comprising:

a ring connected to the first cup and the second cup wherein the ring is adjacent to the second end of the first cup and the second end of the second cup.

12. The system of claim 8 further comprising:

a fastener connecting the first cup and the second cup wherein the fastener is attached to the exterior surface of the bra.

13. The system of claim 8 further comprising:

a strap connected to the bra wherein the strap has a length defined between a first end and a second end wherein the length of the strap is adjustable.

14. The system of claim 8 further comprising:

an adjuster connected to the bra wherein the band size of the bra is changed with the adjuster.

15. A method for supporting a first breast and a second breast of a user, the method comprising the steps of:

providing a bra having an exterior surface of the bra and an interior surface wherein the interior surface of the bra is located in a position opposite to the exterior surface of the bra wherein the bra has a first cup and second cup wherein the first cup has a first end of the first cup and a second end of the first cup which is located in a position opposite to first end of the first cup wherein the second cup has a first end of the second cup and a second end of the second cup which is located in a position opposite to the first end of the second cup wherein the bra has a truss connecting the second end of the first cup to the second end of the second cup wherein the truss has a band size extending from the first cup to the second cup; and connecting a first liner to the interior surface of the bra wherein the first liner is adjacent to first cup of the bra wherein the first liner has a length defined between a first end of the first liner and a second end of the first liner wherein the first end of the first liner is attached to the interior surface of the bra wherein the second end of the first liner is separated from the interior surface of the bra wherein the interior of the bra and the first liner define a first bay wherein the first bay is sized to receive the first breast of the user when the user is wearing the bra wherein the second cup is sized to enclose the second breast of the user when the user is wearing the bra wherein the first liner is made from a mesh wicking fabric wherein the first breast of the user is located between the first liner and the interior surface of the bra when the user is wearing the bra wherein the mesh wicking fabric wicks moisture away from the first breast and decreases heat adjacent to the first breast.

16. The method of claim 15 further comprising the step of:

connecting a second liner to the bra wherein the second liner and the interior surface of the bra define a second bay which is sized to receive the second breast of the user.

17. The method of claim 15 further comprising the step of:

attaching the first end of the first cup to the first end of the second cup.

18. The method of claim 15 further comprising the step of:

changing the band size of the truss.

19. The method of claim 15 further comprising the step of:

attaching a shoulder strap to the bra wherein the shoulder strap and the truss support the first breast and the second breast of the user when the user is wearing the bra.

20. The method of claim 15 further comprising the step of:

connecting a ring to the truss wherein the ring is located between the first cup of the bra and the second cup of the bra.

* * * * *